US006956482B2

(12) United States Patent
Kolton et al.

(10) Patent No.: US 6,956,482 B2
(45) Date of Patent: Oct. 18, 2005

(54) ELECTRONIC ARTICLE SURVEILLANCE MARKER ASSEMBLY AND METHOD FOR MAKING THE SAME

(75) Inventors: Chester Kolton, Westfield, NJ (US); Michael Norman, East Brunswick, NJ (US)

(73) Assignee: B&G Plastics, Inc., Newark, NJ (US)

( * ) Notice: Subject to any disclaimer, the term of this patent is extended or adjusted under 35 U.S.C. 154(b) by 196 days.

(21) Appl. No.: 10/214,789

(22) Filed: Aug. 8, 2002

(65) Prior Publication Data

US 2004/0036610 A1 Feb. 26, 2004

(51) Int. Cl.[7] ..... G08B 13/14
(52) U.S. Cl. ..... 340/572.8
(58) Field of Search ..... 340/571, 572.2–572.7, 340/572.8; 235/487, 488, 491, 493, 489; 361/679; 343/787, 788; 29/825, 829, 830, 831, 832

(56) References Cited

U.S. PATENT DOCUMENTS 4,463,971 A * 8/1984 Hoppe et al. ..... 283/83
5,079,541 A * 1/1992 Moody ..... 340/573.4
5,682,296 A * 10/1997 Horejs et al. ..... 361/737
5,859,587 A * 1/1999 Alicot et al. ..... 340/572.8
5,867,102 A * 2/1999 Souder et al. ..... 340/572.8
5,982,284 A * 11/1999 Baldwin et al. ..... 340/572.8
6,111,506 A * 8/2000 Yap et al. ..... 340/572.1
6,265,977 B1 * 7/2001 Vega et al. ..... 340/572.7
6,294,998 B1 * 9/2001 Adams et al. ..... 340/572.8
6,395,373 B2 * 5/2002 Conti et al. ..... 428/138
6,433,686 B1 * 8/2002 Feibelman ..... 340/572.8
6,481,631 B1 * 11/2002 Poustis ..... 235/488
6,569,508 B2 * 5/2003 Babb et al. ..... 428/40.1

* cited by examiner

*Primary Examiner*—Jeffery Hofsass
*Assistant Examiner*—Jennifer Stone
(74) *Attorney, Agent, or Firm*—Hoffmann & Baron, LLP

(57) ABSTRACT

An EAS marker assembly includes an EAS marker, at least one interior layer having an opening extending therethrough, the EAS marker being resident in the opening, and first and second opposed exterior layers secured to outer surfaces of the at least one interior layer, each of the first and second opposed exterior layers having continuous expanse in overlying relation to the EAS marker. The tag assembly may have an aperture extending therethrough and defined collectively by the at least one interior layer and the first and second exterior layers.

10 Claims, 2 Drawing Sheets

ELECTRONIC ARTICLE SURVEILLANCE MARKER ASSEMBLY AND METHOD FOR MAKING THE SAME

FIELD OF THE INVENTION

This invention relates generally to security from shoplifting of articles of manufacture and pertains more particularly to electronic article surveillance marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

In commonly-assigned U.S. Pat. No. 5,998,462, a garment hanger is disclosed which overcomes the foregoing disadvantages. Therein, a garment hanger is set forth which is comprised of a one-piece body having a hook portion for the receipt of a display rod, a central portion depending from the hook portion and a lower portion for engagement with an article to be displayed. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS marker.

SUMMARY OF THE INVENTION

The present invention has as its primary object the provision of EAS marker assemblies having the benefit of the '462 patent and applicability to articles of manufacture other than hangers.

In attaining this and other objects, the invention at hand provides a tag attachable to an article of manufacture and containing an EAS marker enclosed within the tag, the presence of the EAS marker being unknown to a customer.

More particularly, the invention provides an EAS marker assembly, comprising an EAS marker, at least one interior layer having an opening extending therethrough, the EAS marker being resident in the opening, and first and second opposed exterior layers secured to outer surfaces of the at least one interior layer, each of the first and second opposed exterior layers having continuous expanse in overlying relation to the EAS marker.

The tag assembly preferably has an aperture extending therethrough and defined collectively by the at least one interior layer and the first and second exterior layers.

The EAS marker is of a given rectangular configuration and the opening is of rectangular configuration larger than the given configuration.

The EAS marker assembly further includes an adhesive disposed between the EAS marker and the second exterior layer.

In another aspect, the invention provides an EAS marker assembly, comprising an EAS marker, first and second interior layers mutually secured to one another, each of the first and second interior layers having an opening extending therethrough, the EAS marker being resident in the openings of the first and second interior layers, and first and second opposed exterior layers secured respectively to outer surfaces of the first and second interior layers, each of the first and second opposed exterior layers having continuous expanse in overlying relation to the EAS marker.

The tag assembly preferably has an aperture extending therethrough and defined collectively by the first and second interior layers and the first and second exterior layers.

In a further aspect, the invention provides an EAS marker assembly, comprising an EAS marker, first and second interior layers mutually secured to one another, the first interior layer having an opening extending therethrough, the second interior layer having a recess in registry with the opening, the EAS marker being resident in the opening of the first interior layer and in the recess of the second interior layers, and first and second opposed exterior layers secured respectively to outer surfaces of the first and second interior layers, the tag assembly having an aperture extending therethrough and defined collectively by the first and second interior layers and the first and second exterior layers.

In a first method aspect, the invention provides a method for making an EAS marker assembly comprising the steps of:

(a) securing an interior layer having an opening for residence of an EAS marker to an exterior layer having continuous expanse in underlying relation to the interior layer opening;

(b) disposing an EAS marker in the opening atop the exterior layer, and (c) securing a further exterior layer, having continuous expanse in overlying relation to the EAS marker, to the interior layer.

In a second method aspect, the invention provides a method for making an EAS marker assembly comprising the steps of:

(a) forming individual sheet members into a stack by securing the sheet members to one another;

(b) providing an EAS marker;

(c) forming an opening in the stack having configuration for permitting residence of the EAS marker in the opening;

(d) placing the EAS marker in the opening; and (e) securing at least one further individual sheet member to the stack in overlying relation to the EAS marker.

In the second method aspect, the step (c) is practiced by making a die cut into the stack and forming a floor in the lowermost one of the first-mentioned individual sheet members and including the further step of providing an adhesive between the EAS member and the floor of the lowermost one of the first-mentioned individual sheet members.

The invention will be further understood from consideration of the following description of preferred embodiments thereof and from the drawings where like reference numerals identify like parts throughout.

DETAILED DESCRIPTION OF PREFERRED EMBODIMENTS AND PRACTICES

Figures 1, 2, 3:
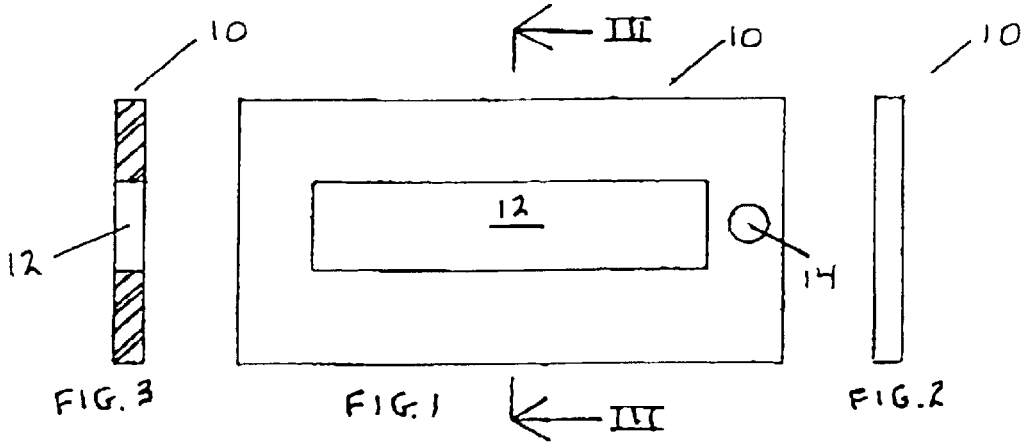
FIG. 1 is a top plan view of a first type of interior layer used in practicing the invention.
FIG. 2 is a right side elevation of FIG. 1.
FIG. 3 is a sectional view as would be seen from plane III—III of FIG. 1.

Referring to FIGS. 1–3, a first type of interior layer 10 used in practicing the invention is comprised of a sheet material, such as cardboard, and defines a central opening 12 and a marginal aperture 14 therethrough.

Figures 4, 5, 6:
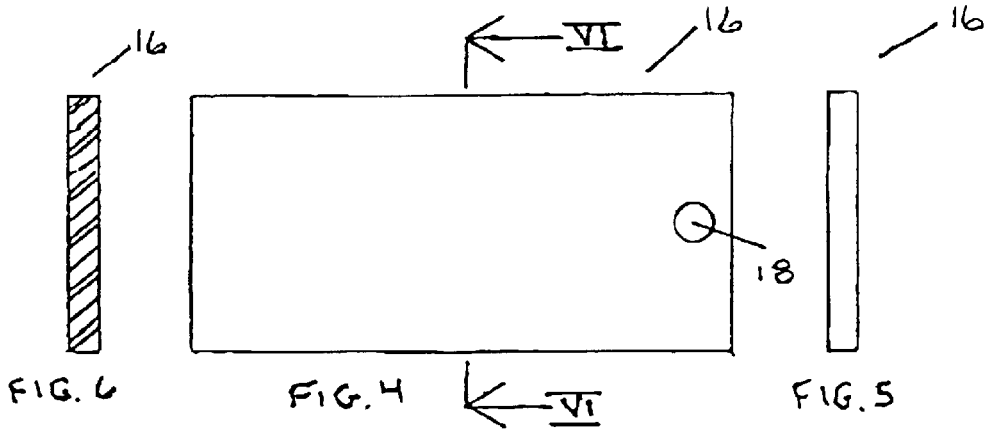
FIG. 4 is a top plan view of an exterior layer used in practicing the invention.
FIG. 5 is a right side elevation of FIG. 4.
FIG. 6 is a sectional view as would be seen from plane VI—VI of FIG. 4.

Turning to FIGS. 4–6, an exterior layer 16 used in practicing the invention is likewise comprised of a sheet material, such as cardboard, and is solid throughout except for defining a marginal aperture 18.

Figures 7, 8, 9:
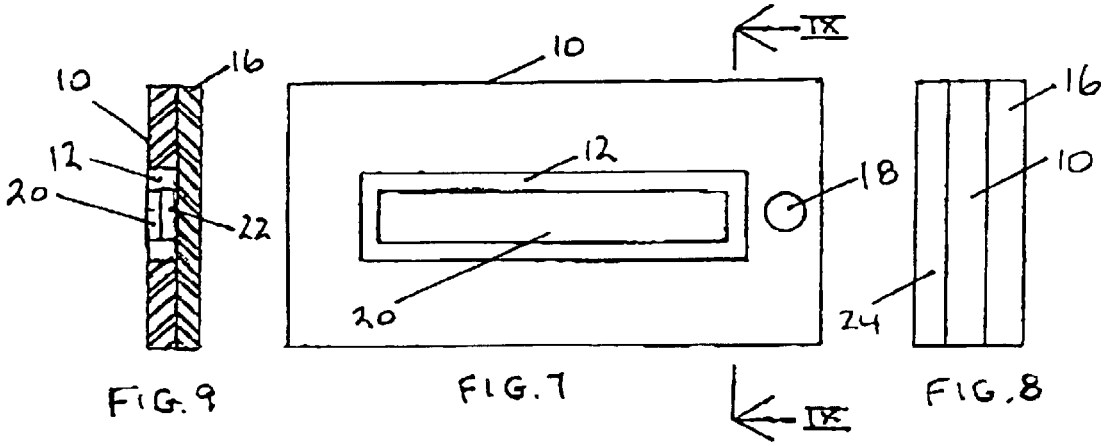
FIG. 7 is a top plan view of an assembly of the FIG. 1 interior layer, a lower exterior layer of type shown in FIG. 4 and an EAS marker.
FIG. 8 is a right side elevation of FIG. 7, with an upper exterior layer of type shown in FIG. 4.
FIG. 9 is a sectional view as would be seen from plane IX—IX of FIG. 7.

In FIG. 7, a partial assembly in accordance with the invention includes an underlayer constituted by exterior layer 16 with interior layer 10 secured to the upper surface of exterior layer 16. An EAS marker 20 is disposed in central opening 12 of interior layer 10 and is secured to exterior layer 16 by an adhesive 22 (FIG. 9). In FIG. 8, an EAS marker assembly is completed by applying exterior layer 24, which is identical to exterior layer 16, to the upper surface of interior layer 10. Apertures 14 and 18 and a like aperture (not shown) in exterior layer 24 are in registry, collectively defining a passage through the assembly and permitting a string of the like to provide for attachment of the assembly to an article of manufacture.

Figure 11:
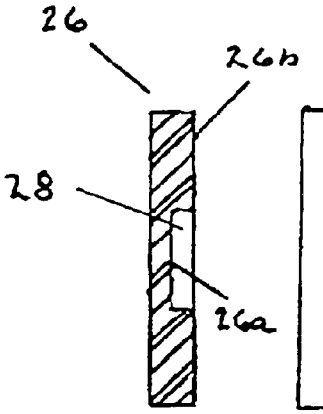
FIG. 11 is a sectional view as would be seen from plane XI—XI of FIG. 10.
Figure 10:
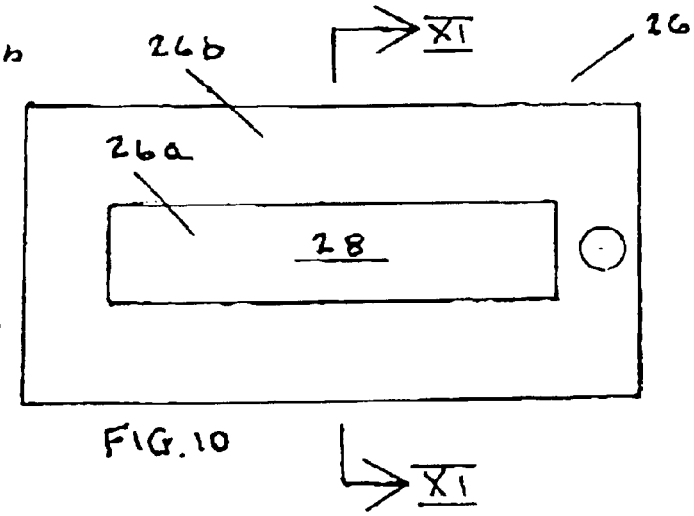
FIG. 10 is a top plan view of a further version of an interior layer usable in practicing the invention.

FIGS. 10 and 11 depict a further version of an interior layer 26 usable in practicing the invention. Layer 26 defines a central recess 28 extending upwardly from floor 26*a* of layer 26 and opening into upper surface 26*b* of layer 26.

Figure 12:
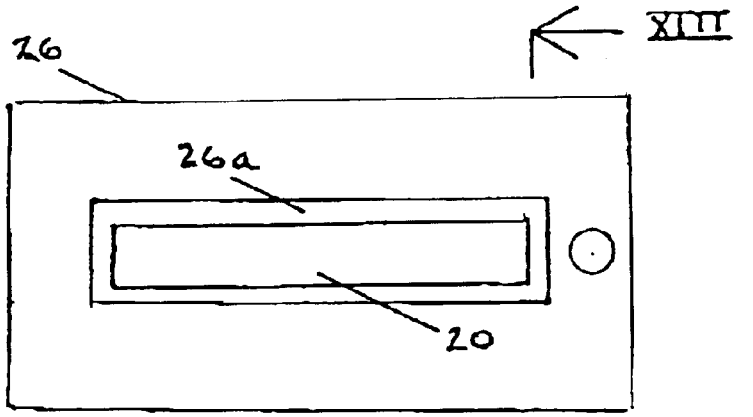
FIG. 12 is a plan view of an assembly of the FIG. 10 interior layer and an EAS marker.
Figure 13:
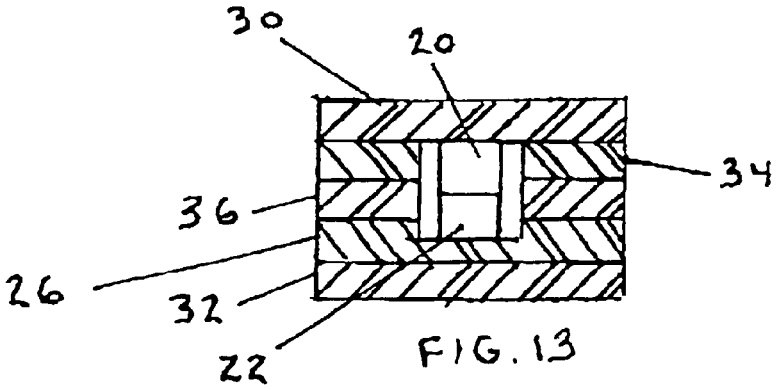
FIG. 13 is a sectional view of an assembly of the FIG. 10 assembly with a further interior layer and exterior layers.

Referring to FIGS. 12 and 13, a further EAS marker assembly in accordance with the invention will be seen to comprise upper exterior layer 30 (FIG. 13), which is omitted from FIG. 12 to show interior detail, and lower exterior layer 32. Layers 30 and 32 are identical in configuration to exterior layer 16 of FIGS. 4–6.

The assembly further comprises interior layers 34, 36 and 26. Interior layers 34 and 36 are identical in configuration to layer 12 of FIGS. 1–3 and layer 24 is configured as above discussed in connection with FIGS. 10 and 11. EAS marker 20 is disposed in the central openings of interior layers 34 and 36 and adhesive 22 is disposed in the central opening of layer 36 and in recess 28 of layer 26.

In reaching the EAS marker assembly of FIG. 8, the invention will be seen to provides a method comprising the steps of:

(a) securing an interior layer having an opening for residence of an EAS marker, i.e., layer 10 having opening 12, to an exterior layer having continuous expanse in underlying relation to opening 12, i.e., exterior layer 16;

(b) disposing an EAS marker in the opening atop the exterior layer, i.e., EAS marker 20 is disposed in opening 12 and secured by adhesive 22 to layer 16; and (c) securing a further exterior layer, having continuous expanse in overlying relation to the EAS marker, to the interior layer, i.e., layer 24 is secured to layer 10 in overlying relation to EAS marker 20.

In reaching the EAS marker assembly of FIG. 13, the invention will be seen to provides a method comprising the steps of:

(a) forming individual sheet members into a stack by securing the sheet members to one another, i.e., securing interior layers 34, 36 and 26 to form the stack;

(b) providing an EAS marker, i.e., EAS marker 20;

(c) forming an opening in the stack having configuration for permitting residence of the EAS marker in the opening, i.e., the central openings of layers 34 and 36 and recess 28 of layer 26;

(d) placing the EAS marker in the opening, i.e., EAS marker 20 is placed in the stack opening; and (e) securing at least one further individual sheet member to the stack in overlying relation to the EAS marker, i.e., securing at least exterior layer 30 to the upper surface of interior layer 34.

Various changes may be introduced in the disclosed preferred embodiments and practices without departing from the invention. Accordingly, it is to be appreciated that the true spirit and scope of the invention is set forth in the following claims.

What is claimed is:

1. A method of making an EAS marker assembly comprising the steps of:

providing a first exterior layer;

disposing a plurality of stacked sheet members over said exterior layer, said stacked sheet members providing an opening therethrough such that said exterior layer defines a floor of said opening;

inserting an EAS marker into said opening;

placing said EAS marker onto said floor; and securing a second exterior layer over said sheet members in closing relationship to said opening.

2. A method of claim 1 wherein said disposing step includes forming said opening by die cutting.

3. A method of claim 1 wherein said placing step includes securing said EAS marker to said floor.

4. A method of claim 3 wherein said securing step includes providing an adhesive between said EAS marker and said floor.

5. A method of claim 1 wherein said sheet members are of a same material.

6. A method of claim 5 wherein said first exterior layer is of said same material.

7. A method of claim 6 wherein said second exterior layer is of said same material.

8. An EAS marker provided by the method of claim 1.

9. An EAS marker provided by the method of claim 3.

10. An EAS marker provided by the method of claim 7.

* * * * *